US005836774A

United States Patent [19]

Tan et al.

[11] Patent Number: 5,836,774

[45] Date of Patent: Nov. 17, 1998

[54] ADAPTER AND MECHANISM THEREOF

[75] Inventors: Haw-Chan Tan, Diamond Bar; Gordon Lok, Montebello; Joel J. Yeh, San Gabriel, all of Calif.; Sung Liu Hsu, Taipei Hsien, Taiwan

[73] Assignee: Hon Hai Precision Ind. Co., Ltd., Taipei Hsien, Taiwan

[21] Appl. No.: 748,101

[22] Filed: Nov. 12, 1996

[51] Int. Cl.[6] ..... H01R 9/09

[52] U.S. Cl. ..... 439/76.1; 439/610; 439/906

[58] Field of Search ..... 439/76.1, 607, 439/610, 906, 731

[56] References Cited

U.S. PATENT DOCUMENTS

| | | | |
|---|---|---|---|
| 4,971,574 | 11/1990 | Garcia | 439/497 |
| 5,174,789 | 12/1992 | Yu et al. | 439/607 |
| 5,195,909 | 3/1993 | Huss et al. | 439/610 |
| 5,352,135 | 10/1994 | Lenoir | 439/607 |

*Primary Examiner*—P. Austin Bradley
*Assistant Examiner*—T C Patel

[57] ABSTRACT

An adapter (10) includes a pair of male/female connectors (12, 14) solderably positioned on two ends of a PC board (16). A pair of identical metal shells (20) are adapted to be engaged with each other with their grounding tangs (38) extending at two ends thereof, respectively, for conductive engagement with the metal shieldings (60, 80) of such pair of connectors (12, 14). The metal shells (20) also defines a space for protectively enclosing the PC board (16) therein. A pair of identical plastic covers (40) are fixedly aligned and attached to each other commonly enclosing such pair of metal shells (20) therein. The metal shells (20) are restrained between the pair of connectors (12, 14), and fixedly aligned with the corresponding covers (40), respectively. The connectors (12, 14) are aligned with and confinably received within the covers (40). Two interconnection ports of such pair of connectors (12, 14) are respectively exposed to the exterior at opposite ends of the adapters (10).

19 Claims, 9 Drawing Sheets

ADAPTER AND MECHANISM THEREOF

BACKGROUND OF THE INVENTION

1. Field of The Invention

The invention relates to electrical adapters, and particularly to the adapter for use with SCSI type interconnection and mechanism thereof.

2. The Related Art

Most adapters for use with cable end interconnections are generally made by a pair of male/female connectors with a PC board therebetween. The PC board is successively then covered by a so-called inner-molded or pre-molded epoxy layer to be protectively and isolatably buried under such layer. A shielding metal foil for EMI (Elector-Magnetic Interference) designedly surrounds such epoxy layer. Lastly, a jacket is applied to circumferentially cover the shielding metal foil by a over-molding process with two connection ports of those two male/female connectors exposed to an exterior for interconnection with other counterpart connectors of a cable.

Moreover, other than using the aforementioned structures, other types may use a die-casting shell or an insulative plastic shell coated with metal by plating for consideration of EMI. Regardless of whatever the adapter used, the parts cost or the manufacturing cost takes a substantially portion of the total cost of each adapter unit.

Additionally, from a viewpoint of manufacturing or assembling, most existing adapters use the screw-fastening or the hook-latching method for finalizing the whole assembly. Those type assembling may be easily loosened or disassembled by significant vibration.

Therefore, an object of the invention is to provide an adapter having a more reliable and easy-to-assemble structure in comparison with the prior arts.

SUMMARY OF THE INVENTION

According to an aspect of the invention, an adapter includes a pair of male/female connectors solderably positioned on two ends of a PC board. A pair of identical metal shells are adapted to be engaged with each other with their grounding tangs extending at two ends thereof, respectively, for conductive engagement with the metal shieldings of such pair of connectors. The metal shells also defines a space for protectively enclosing the PC board therein. A pair of identical plastic covers are fixedly aligned and attached to each other commonly enclosing such pair of metal shells therein. The metal shells are restrained between the pair of connectors, and fixedly aligned with the corresponding covers, respectively. The connectors are aligned with and confinably received within the covers. Two interconnection ports of such pair of connectors are respectively exposed to the exterior at opposite ends of the adapters.

BRIEF DESCRIPTION OF THE DRAWINGS

FIG. 4(A) is an exploded perspective view of the latch device.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
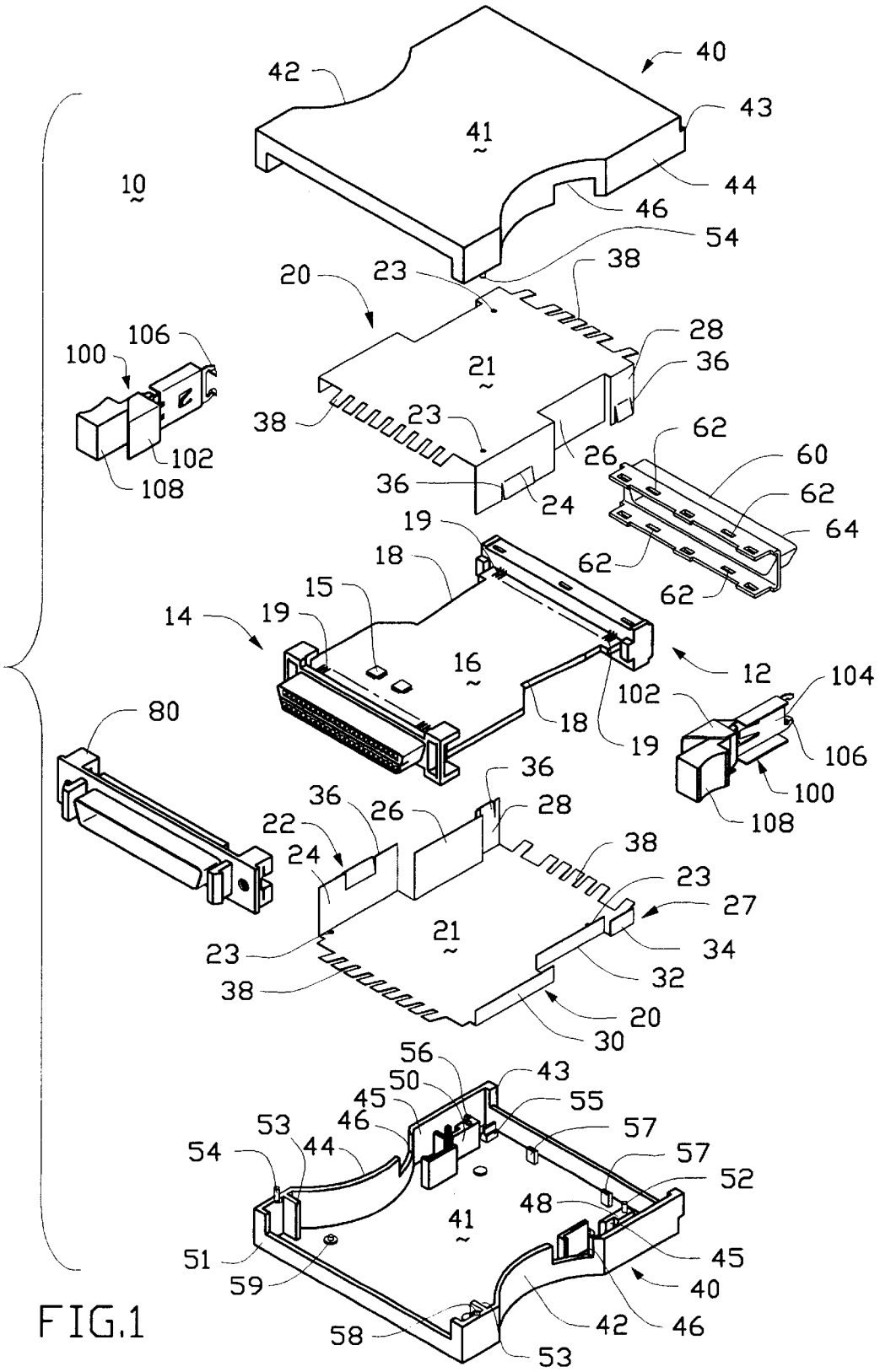
FIG. 1 is an exploded perspective view of an presently preferred embodiment of an adapter according to the invention.

It will be noted here that for a better understanding, most of like components are designated by like reference numerals throughout the various figures in the embodiments. Attention is directed to FIG. 1 wherein an adapter 10 includes a male connector 12 and a female connector 14 respectively positioned at two ends of a PC board 16 on which a plurality of electrical components 15 are mounted.

Figure 2:
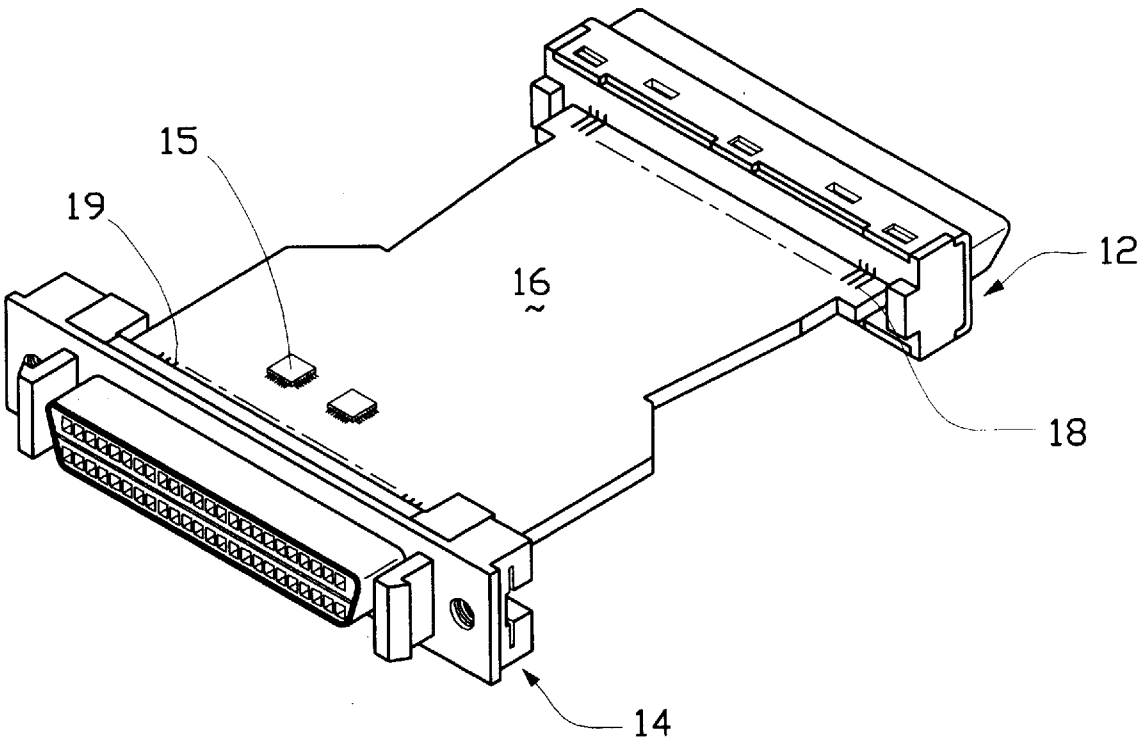
FIG. 2 is a perspective view of a first assembly including the PC board and the connectors of FIG. 1.

Also referring to FIG. 2, each of the connector 12, 14 has plural contacts 19 having contact tails straddling the PC board 16, so that the PC board is generally positioned at the mid-level with regard to the two connectors 12, 14. The PC board 16 has recesses 18 on its two sides.

Figure 3:
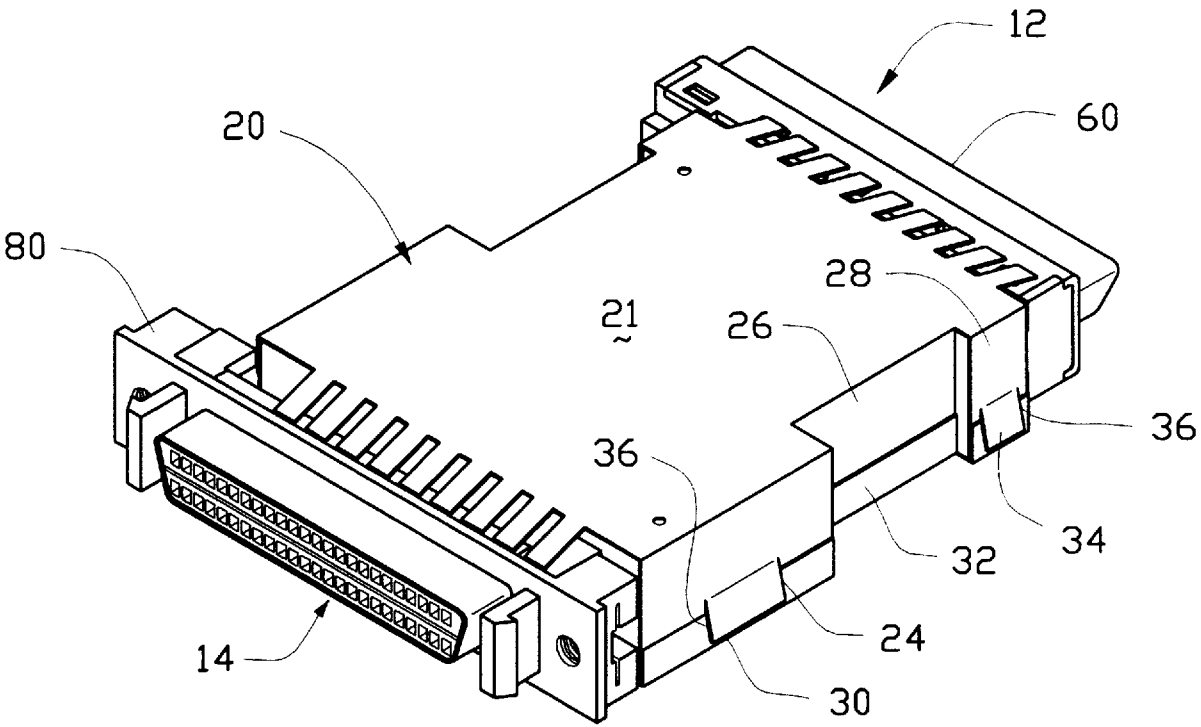
FIG. 3 is a perspective view of a second assembly including the pair of metal shells of FIG. 1 and the first assembly of FIG. 2.

Also referring to FIG. 3, a pair of identical metal shells are adapted to be fastened to each other and to enclose the PC board 16 therein. Each metal shell 20 includes a base 21, a first side wall 22 consisting of a first high section 24, a second high section 26 and a third high section 28, and a second side walls 27 consisting of a first low section 30, a second low section 32 and a third low section 34 wherein the second high section 26 and the second low section 32 are respectively received within the recesses 18 of the board 16, respectively. Each of the first high section 24 and the third high section 28 forms an engagement slit 36 for respectively receiving the corresponding first low section 30 and third low section 34 therein, thus allowing assembling this pair of metal shells 20 together.

Each metal shell 20 further includes a first row and a second row of grounding tangs 38 at two opposite ends thereof for respective conductive engagement with the corresponding metal housing 60 of the male connector 12 and metal housing 80 of the female connector 14. It can be seen that each metal shell 20 generally confinably positioned between the pair of connectors 12, 14. Thus, the pair of metal shells 20 can generally assembled with the PC board 16 and the associated connectors 12, 14.

Figure 4:
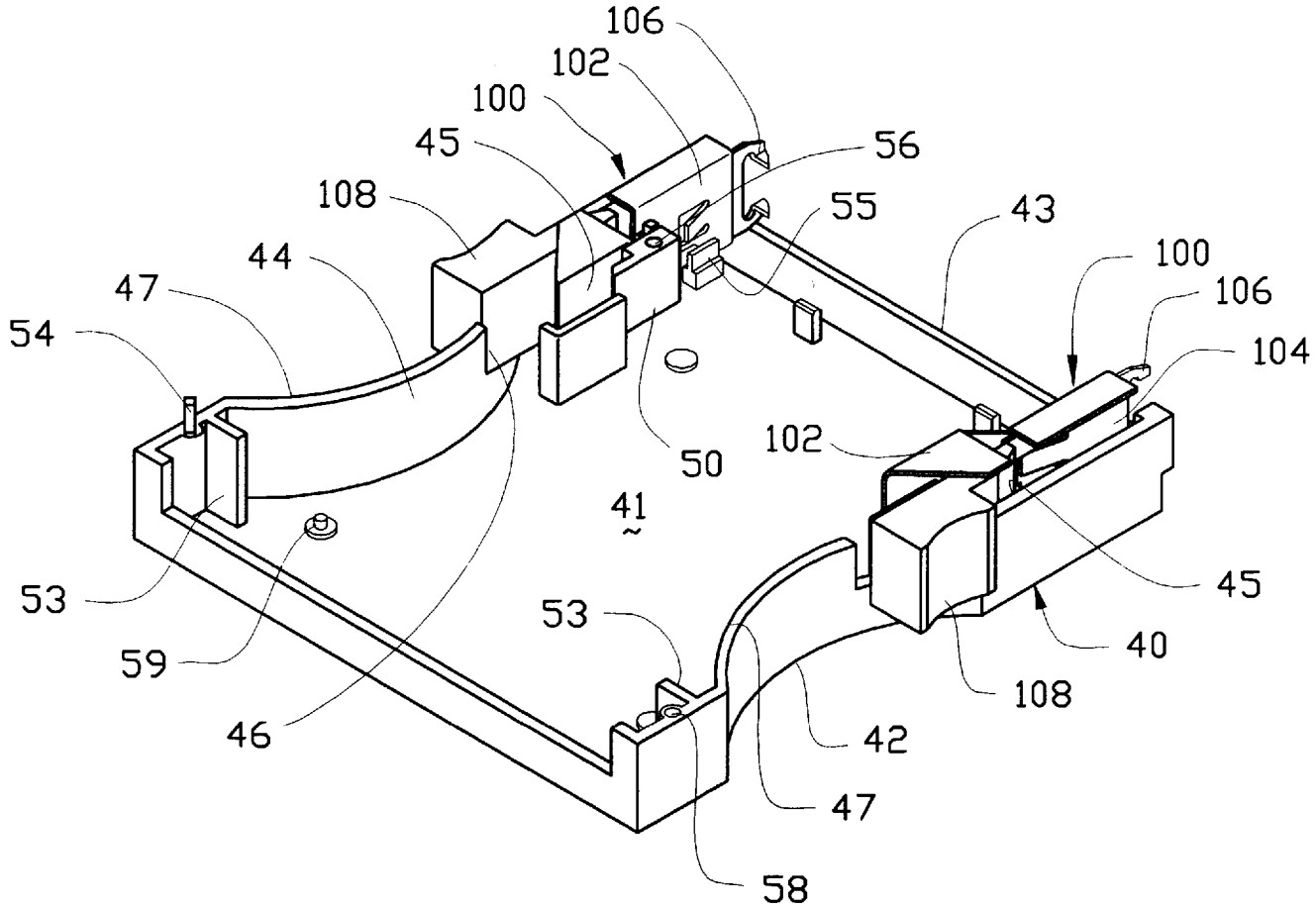
FIG. 4 is a perspective view of half of a third assembly including a pair of latch devices and a pair of plastic covers of FIG. 1.
Figure 4:
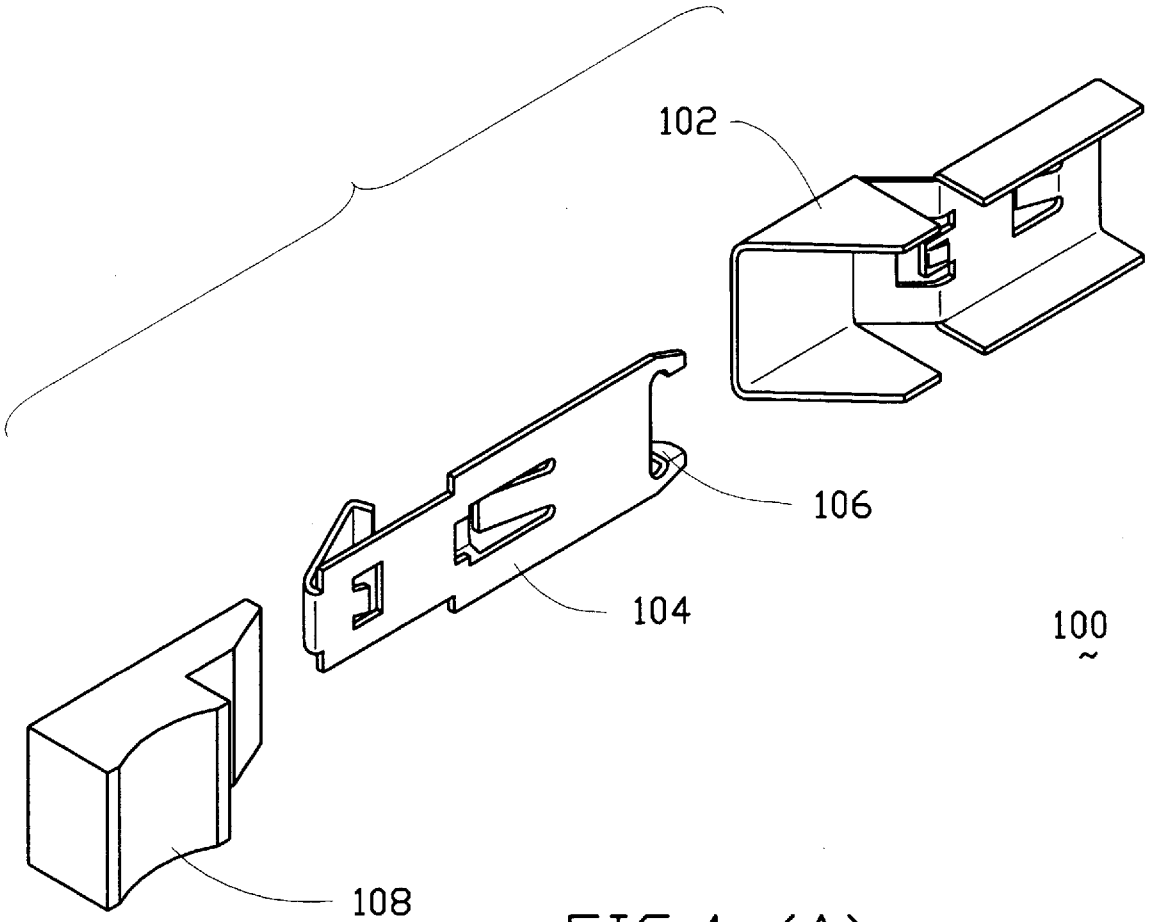

Also referring to FIG. 4, each of a pair of identical covers 40 includes a base plate 41, a first side wall 42 and a second side wall 44 wherein each side wall 42, 44 has an opening 46 therein. A pair of inner walls 48, 50 are positioned by an inner side of each side wall 42, 44 so as to define a latch-receiving space 45 between the inner walls 48, 50 and the side wall 42, 44.

A pair of first posts 52, 54 respectively extend from an inner wall 48 and a side wall 44 in a diagonal arrangement. Correspondingly, a pair of post-receiving holes 56, 58 are disposed in an inner wall 48 and a side wall 42 in another crossing diagonal arrangement. Therefore, when these pair of covers 40 are assembled with each other, such pair of posts 52, 54 of one cover 40 can be aligned and received within the corresponding holes 56, 58 of the other cover 40.

A pair of second posts 59 (only one shown) extend from the base plate 41 in a diagonal arrangement in the same direction of the arrangement of the posts 52, 54 for alignment with and reception within a pair of diagonal apertures 23 in the base 21 of the metal shell 20. Therefore, the pair of metal shells 20 can be confinably aligned with and enclosed within the pair of plastic covers 40.

A pair of protrusions 57 are formed adjacent one end of the base plate 41 for receivable engagement within a pair of corresponding retention holes 62 in the housing 60 of the male connector 12. Also, a pair of restraint bars 55 (only one shown) are formed adjacent the same end of the base plate 41 so that the male connector 12 can be snugly and fixedly received within the pair of covers 41 in position when assembled. Similarly, a pair of restriction bars 53 are formed adjacent the opposite end of the base plate 41 for cooperation with the end wall 51 and the side walls 42, 44, thus confining the female connector 14 thereabouts. Therefore, the female connector 14 can be retained in position in the covers 40 after assembled.

Also referring to FIG. 4(A), a pair of latch devices 100 are respectively received generally within the latch receiving space 45 in the covers 40. Each latch device 100 includes a main body 102 substantially positioned within the space 45, a locking lever 104, which is rotatably fastened to the main body 102, with a hook section 106 extending forward out of the front face 43 of the cover 40 and positioned by two sides of the mating portion 64 of the male connector 12 (FIG. 5), and a pressing section 108 exposed to an exterior through the opening 46 in the side walls 42, 44.

Figure 5:
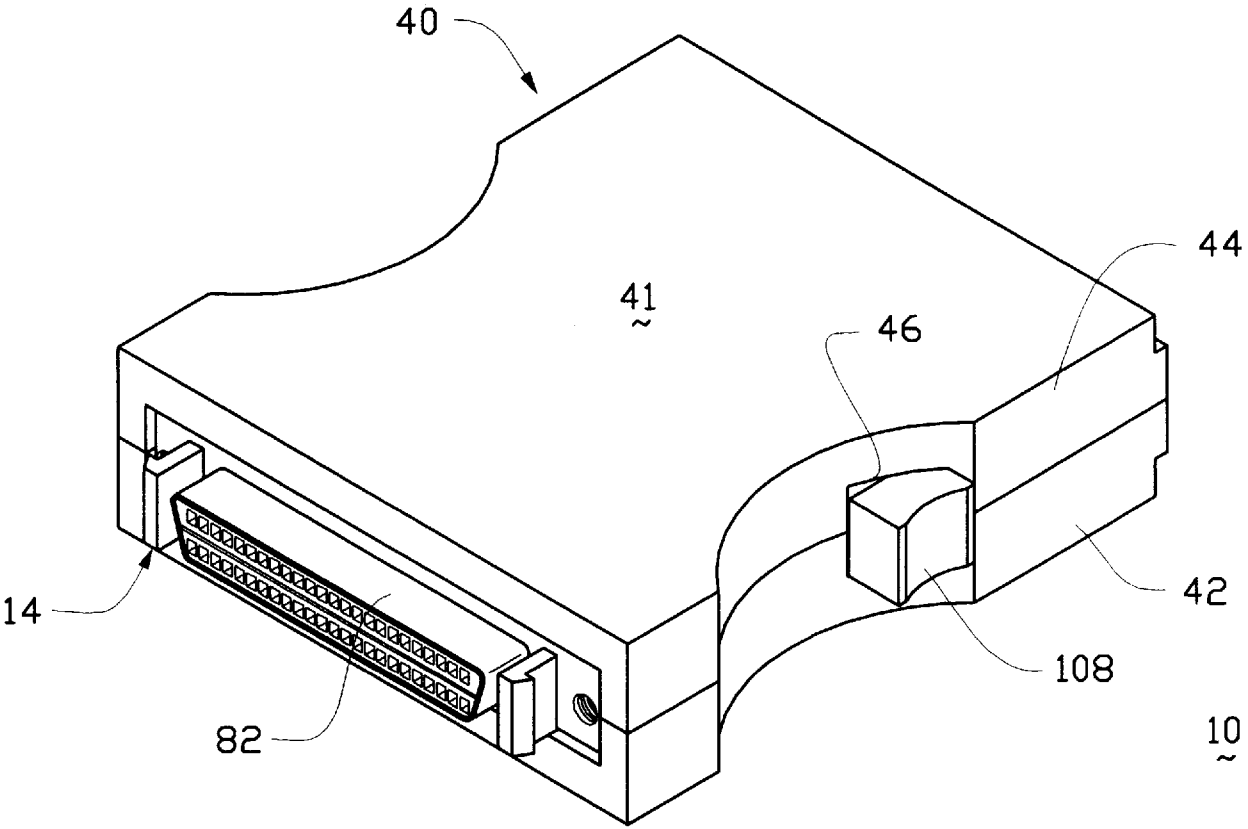
FIG. 5 is a perspective view of a fourth or final assembly including the third assembly of FIG. 4 and the second assembly of FIG. 2.
Figure 6:
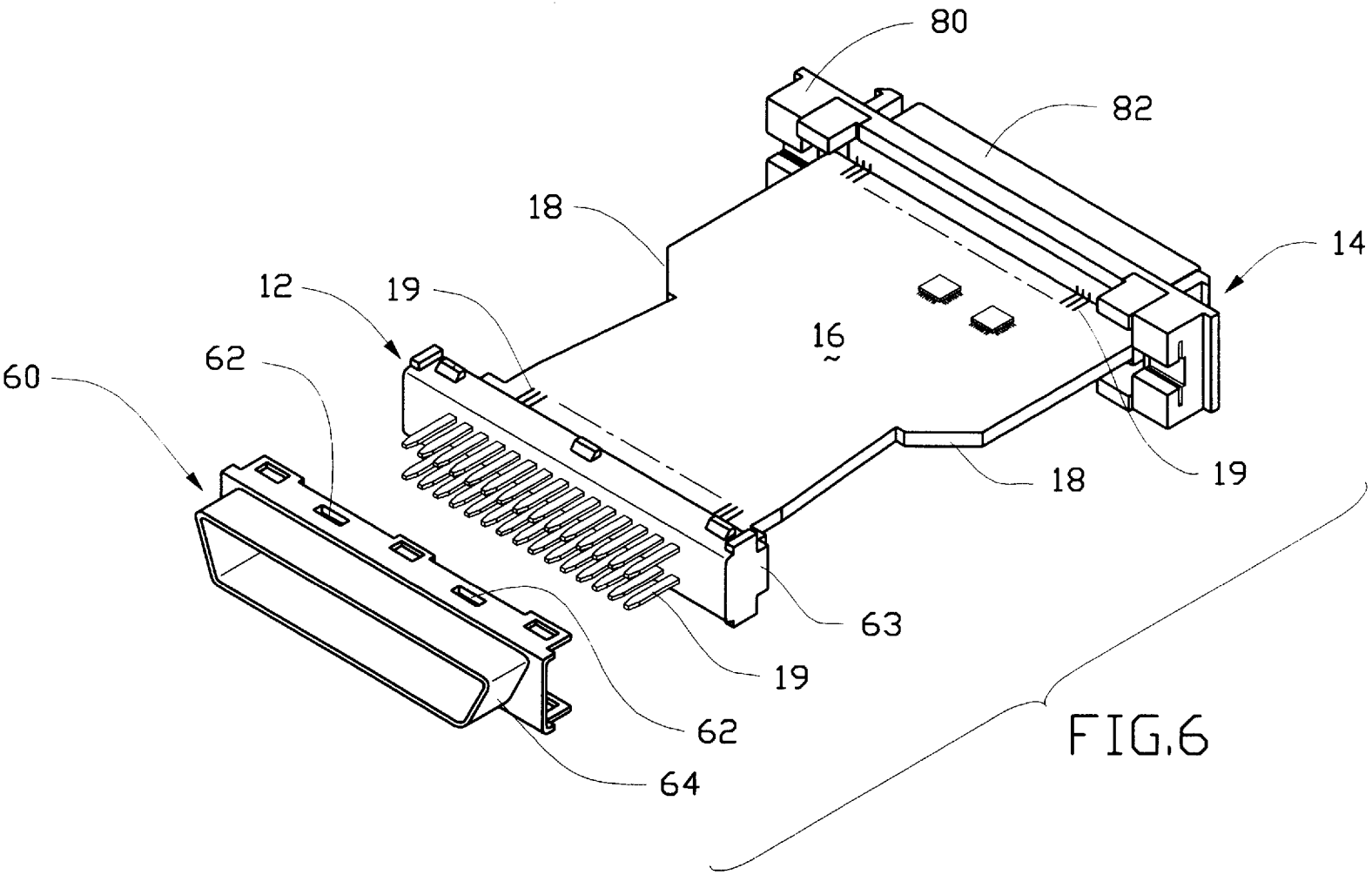
FIG. 6 is an exploded perspective view of the male connector with the female connector assembled on the board at the opposite end of FIG. 1 to show how the plastic housing and the metal housing are assembled with each other.
Figure 7:
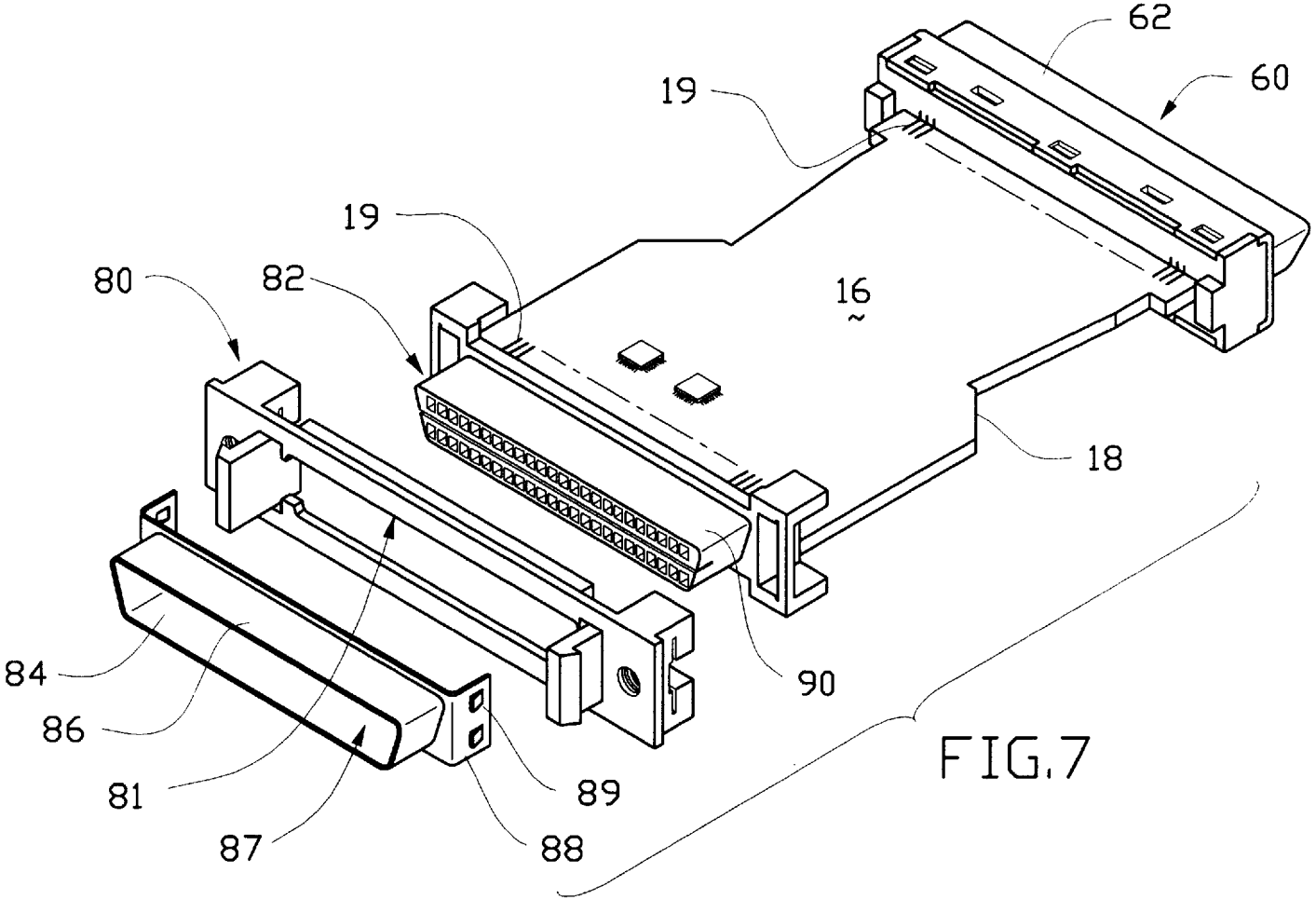
FIG. 7 is an exploded perspective view of the female connector with the male connector assembled on the board at the opposite end of FIG. 1 to show how the metal enclosure, the plastic housing and the metal housing are assembled with one another.

Also referring to FIGS. 5–7, when assembled, the PC board 16 and its associated male connector 12 and female connector 14 is snugly received within the pair of covers 40 with the mating portion 64 of the male connector 12 and the mating portion 82 of the female connector 14 exposed to an interior at two opposite ends of the covers 40. As aforementioned, other than the pre-assembling among the male connector 12, the female connector and the PC board 16, in this embodiment, the male connector 12, the female connector 14 and the PC board 16 can be restrainedly positioned with regard to the covers 40, respectively, so that the whole adapter assembly 10 has a good self-internal fixation thereof. Under this situation, each pressing section 108 of the latch device 100 can be exposed to an interior by two sides of the adapter assembly 10 for easy access and actuation of engagement and disengagement of the hook section 106 with regard to the complementary cable connector (not shown). It should be noted that after the all components of the whole adapter assembly 10 have assembled together in their relative positions, the covers 40 can be fastened to each other by an ultrasonic process along their opposing edges 47 thereof (FIG. 4). Accordingly, the whole adapter assembly 10 has an externally sealed and internally secured structure.

FIG. 6 shows the male connector 12 including the metal housing 60 generally enclosing a plastic housing 63 with a plurality of contacts 19 therein. As mentioned before, the metal housing 60 has retention holes 62 for latchable engagement with the protrusions 57 on the covers 40.

Figure 8:
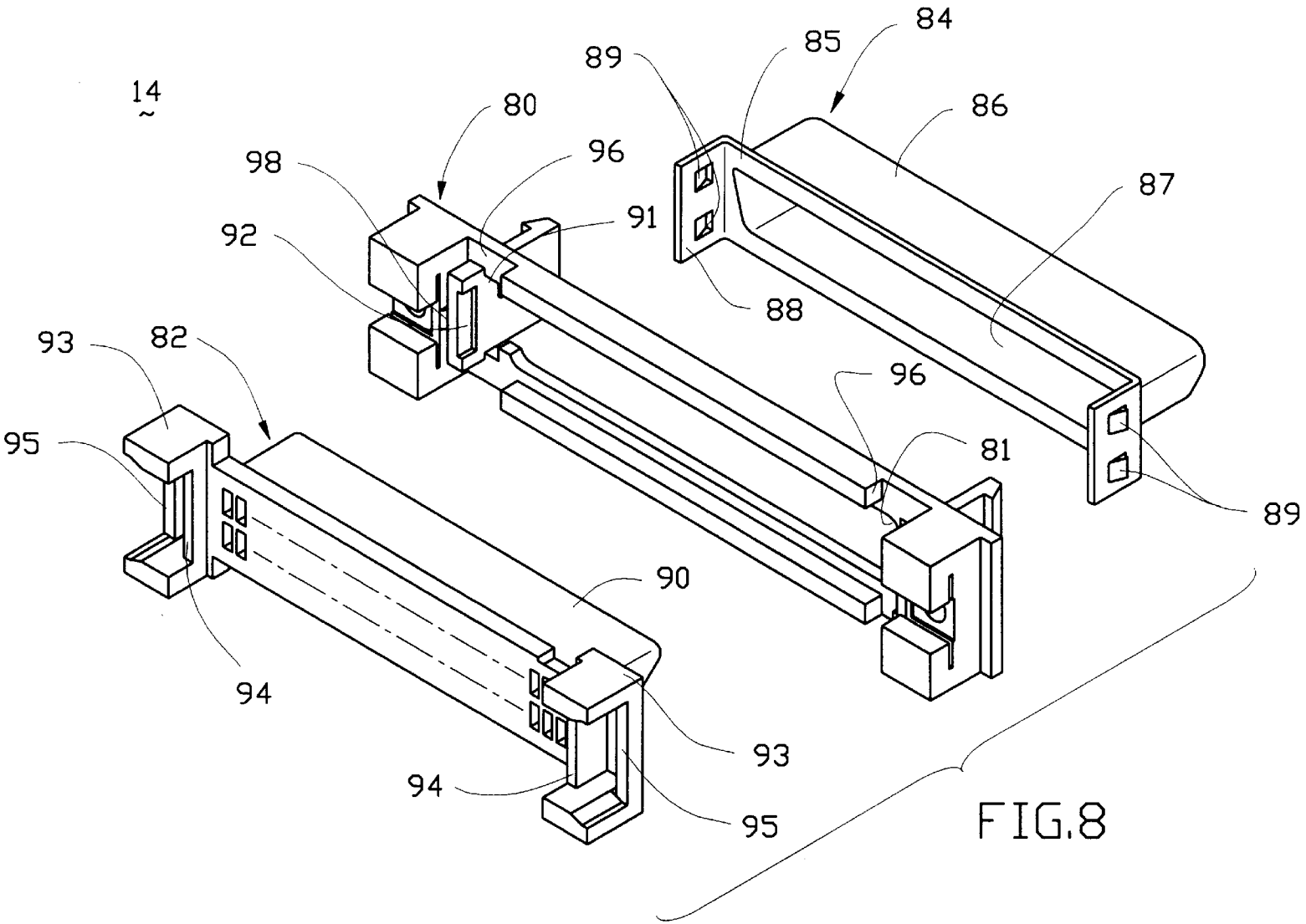
FIG. 8 is an exploded perspective view of the female connector of FIG. 1 to show how the metal enclosure, the plastic housing and the metal housing are assembled with one another.

FIGS. 7 and 8 show the female connector 14 including a die-cast metal housing 80, a plastic housing 82 and a metal enclosure 84. The metal enclosure 84 includes a flange 85, a shell 86 upstanding from the flange 85 and defining an island receiving opening 87 therein. The metal enclosure 84 further includes a pair of tabs 88 downward extend at two opposite ends of the flange 85 with locking lances 89 thereof.

The metal housing 80 forms a central opening 81 in alignment with the opening 87 of the metal enclosure 84 for receiving a main body 90 of the plastic housing 82 therein, and a pair of slots 91 (only one shown) for receiving the corresponding tabs 88 therein. A locking bar 92 is formed in the slot 91 for latchable engagement with the lances 89 of the metal enclosure 84 so that the metal enclosure 84 can be fastened to the metal housing 80.

The plastic housing 82 includes the main body 90 enclosing a plurality of contacts 18 therein. A pair of support platforms 93 are formed at two opposite ends of the plastic housing 82 for reception with the corresponding recesses 96 in the back portion of the metal housing 80 wherein each platform 93 includes a first bar 94 abutting against the corresponding tab 88 of the metal enclosure 84 so as to assure that the lances 89 of the tab 88 of the metal enclosure 84 have a reliable latchable engagement with the locking bar 92 of the metal housing 80. Each platform 93 further includes a second bar 95 which is locked and pressed by a locking protrusion 98 of the metal housing 80 so that the plastic housing 82 can be fastened to the metal housing 80. Accordingly, the metal housing 80, the plastic housing 82 and the metal enclosure 84 can be fastened one another to finalize the whole female connector 14.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An adapter comprising:

a first connector and a second connector positioned at two opposite ends of a PC board, each of said first connector and second connector having a metal housing;

a pair of identical metal shells commonly defining a space for receiving said PC board therein, and positioned between said first connector and said second connector;

each of said metal shells including a first row and a second row of grounding tangs at two opposite ends thereof for conductive engagement with the corresponding metal housings of the connectors; and a pair of identical plastic cover commonly enclosing the metal shells and the connectors therein.

2. The adapter as defined in claim 1, wherein said metal shells has first means for cooperation with second means of the plastic covers for alignment of the metal shells with the plastic covers.

3. The adapter as defined in claim 2, wherein said first means includes holes and said second means includes posts.

4. The adapter as defined in claim 1, wherein said plastic covers include means for alignment with each other.

5. The adapter as defined in claim 4, wherein said means includes posts and holes.

6. The adapter as defined in claim 1, wherein said plastic covers include third means for cooperation with fourth means of the connectors for alignment of the connectors with the plastic covers.

7. The adapter as defined in claim 6, wherein said third means includes protrusions and said fourth means includes apertures.

8. The adapter as defined in claim 1, wherein said pair of plastic covers are fastened with each other by an ultrasonic process for sealing along opposing edges thereof.

9. The adapter as defined in claim 1, wherein each of said pair of metal shells includes a base, and a high side wall section and a low side wall section are respectively positioned two sides of said base.

10. The adapter as defined in claim 1, wherein said adapter further includes a pair of latch devices on two sides.

11. The adapter as defined in claim 1, wherein each of said connectors includes two rows of contacts straddling the PC board so that the PC board is positioned at a mid-level with regard to the connectors.

12. A method for assembling an adapter, the step comprising:

providing a pair of connectors positioned at two opposite ends of a PC board;

providing a pair of metal shells defining a space for receiving said PC board therein and generally positioned between said pair of connectors wherein grounding means is provide on the metal shells for conductive engagement with the connectors; and providing a pair of plastic covers enclosing therein the metal shells and the connectors wherein mating portions of the connectors are exposed to an interior for mating with complementary connectors.

13. The method as defined in claim 12, wherein the PC board is positioned at a mid-level with regard to the connectors, and said pair of metal shells are identical with each other.

14. The method as defined in claim 13, wherein said plastic covers are identical with each other.

15. The method as defined in claim 12, wherein means is provided for aligning the plastic covers with each other.

16. The method as defined in claim 12, wherein means is provided for aligning the metal shells with the plastic covers.

17. The method as defined in claim 12, wherein means is provided for aligning the connectors with the plastic covers.

18. The method as defined in claim 12, wherein the step further includes sealing the pair of opposing plastic covers by an ultrasonic process.

19. A female connector (14) for use with an adapter (10), comprising:

a metal housing (80) defining a first opening (81) and a pair of slots (91) each of which communicates with the first opening (81) and forms therein a notched locking bar (92);

a metal enclosure (84) including a flange (85), a shell (86) upstanding from the flange (85) and defining a second opening (87) therein in alignment with the first opening (81) of the metal housing (80), and a pair of tabs (88) downward extend from two opposite ends of the flange (85) with locking lances (89) thereof for latchable engagement with the locking bar (92) of the metal housing (80); and a plastic housing (82) including a main body (90) with a plurality of contacts (18) therein, and a pair of platforms (93) positioned at two opposite ends of the main body (90) wherein each of said platforms (93) includes a first bar (94) abutting against the corresponding tab (88) of the metal enclosure (84), and a second bar (95) which is parallel to and spaced with the first bar (94), and is locked and pressed by a locking protrusion (98) of the metal housing (80) close to the corresponding slot (91), whereby the metal enclosure (84) and the plastic housing (82) can be fastened to the metal housing (80), respectively, thus forming a whole assembly unit of said female connector (14).

* * * * *